United States Patent [19]

Meyers

[11] 4,284,197

[45] Aug. 18, 1981

[54] RECEPTACLE HAVING FRANGIBLE MEANS

[75] Inventor: George Meyers, Ashland, Ohio

[73] Assignee: The Garber Company, Ashland, Ohio

[21] Appl. No.: 125,492

[22] Filed: Feb. 28, 1980

[51] Int. Cl.[3] ..... B65D 17/16

[52] U.S. Cl. ..... 206/626; 229/44 CB; 229/37 R; 225/48

[58] Field of Search ..... 229/44 CB; 206/626, 206/622, 630, 629, 604, 623, 624, 621, 625, 611; 225/48, 49, 50

[56] References Cited

U.S. PATENT DOCUMENTS

| | | | |
|---|---|---|---|
| 4,113,104 | 9/1978 | Meyers | 206/626 |
| 4,127,229 | 11/1978 | Roccaforte | 229/44 CB |
| 4,215,783 | 8/1980 | Vanderlugt, Jr. | 206/626 |

*Primary Examiner*—George T. Hall
*Attorney, Agent, or Firm*—Yount & Tarolli

[57] ABSTRACT

An improved receptacle includes a cover which is connected with a rear panel of the receptacle along a fold line to enable the cover to be pivoted between open and closed positions. Prior to opening of the receptacle, a front section of the cover is firmly held in juxtaposition with a front panel of the receptacle so that the cover cannot be partially raised under the influence of forces applied to the receptacle during handling. When the cover is firmly pulled open, a rip out section is torn from the front panel to form an opening which extends downwardly from an upper edge of the front panel. The rip out section is secured to the inside of the front section of the cover by adhesive. When the cover is closed, indentations formed in the rip out section are engaged by projections formed in the opening in the front panel to hold the cover closed. In certain embodiments, a pair of retaining surfaces are connected with the inside of the cover and are engaged by retaining tabs which are pivotally connected with an upper edge of the front panel to further hold the cover closed.

9 Claims, 10 Drawing Figures

RECEPTACLE HAVING FRANGIBLE MEANS

BACKGROUND OF THE INVENTION

This invention relates generally to a receptacle and more specifically to a receptacle having a cover which is pivotal between open and closed positions.

There are many known receptacles having pivotally mounted covers or flip tops. One of these known receptacles is disclosed in U.S. Pat. No. 4,127,229 and includes a cover having a front section which is secured by adhesive to an upper portion of a front panel of the receptacle. Upon lifting of the cover, the front section of the cover separates the upper portion of the front panel from a lower portion of the front panel to expose the contents of the receptacle.

Another receptacle having a pivotally mounted cover is disclosed in U.S. Pat. No. 3,893,614. The receptacle disclosed in this patent includes a sealing tab which is releasably attached to an upper edge of a front panel of the receptacle. The sealing tab is secured by adhesive to an inner surface of the front panel. A pair of locking or retaining tabs are also connected with the upper edge of the front panel along fold lines. The retaining tabs cooperate with flaps on the inside of the cover to hold the cover closed after the receptacle has initially been opened.

SUMMARY OF THE PRESENT INVENTION

A receptacle constructed in accordance with the present invention includes a cover which is pivotally connected with a back panel for movement between open and closed positions. A front panel of the receptacle has a rip or pull out section which is defined by a score line. Adhesive connects the rip or pull out section in flat juxtaposition with an inner side of a front section of the cover to hold the front section of the cover in flat abutting engagement with the front panel prior to opening of the receptacle. When the receptacle is initially opened, the adhesive causes the rip out section to tear away from the front panel of the receptacle to form an opening in the front panel and expose the contents of the receptacle.

Once the receptacle has been opened and the cover moved back to the closed position, a pair of locking or retaining tabs on the upper edge portion of the front panel engage surfaces on the inside of the front section of the cover to hold the cover in the closed position. In addition, the cover is held in the closed position by meshing engagement between indentations and projections formed by removing the rip out section from the front panel of the receptacle.

Accordingly, it is an object of this invention to provide a new and improved receptacle having a pivotally mounted cover which is secured to a rip out section formed in a front panel of the receptacle to firmly hold the cover in place before initial opening of the receptacle.

Another object of this invention is to provide a new and improved receptacle as set forth in the preceding object and wherein retaining tabs cooperate with the cover to hold it closed after it has been intially opened and then returned to the closed position.

BRIEF DESCRIPTION OF THE DRAWINGS

The foregoing and other objects and features of the present invention will become more apparent upon a consideration of the following description taken in connection with the accompanying drawings wherein.

DESCRIPTION OF SPECIFIC PREFERRED EMBODIMENTS OF THE INVENTION

Figure 1:
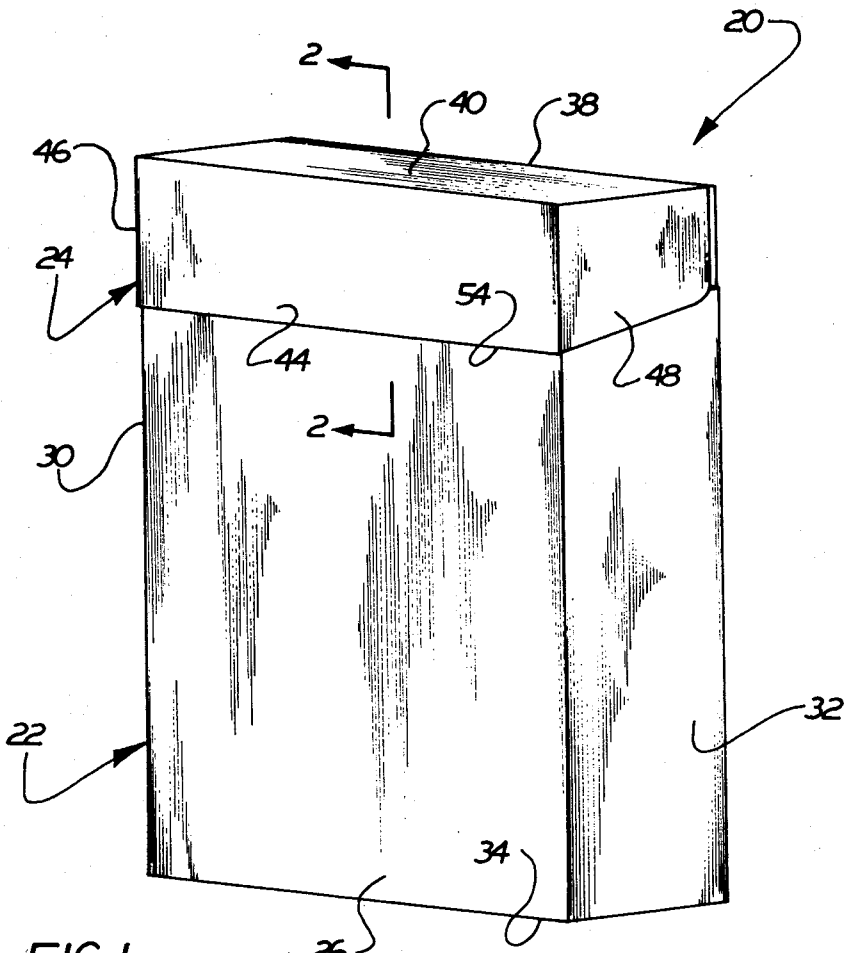
FIG. 1 is a perspective view of a closed receptacle constructed in accordance with the present invention.

A receptacle or box 20 (FIG. 1) includes a rectangular body 22 which is closed by a cover or flip top 24. The body 22 includes flat parallel front and rear panels 26 and 28 (see FIGS. 1 and 2) which are interconnected by a pair of flat parallel side panels 30 and 32. A flat bottom panel 34 (FIG. 1) extends perpendicular to the front and rear panels 26 and 28 and the side panels 30 and 32. The bottom panel 34 interconnects the front, side and rear panels to form a rectangular paperboard receptacle for receiving articles such as individually wrapped packages of food.

Figure 2:
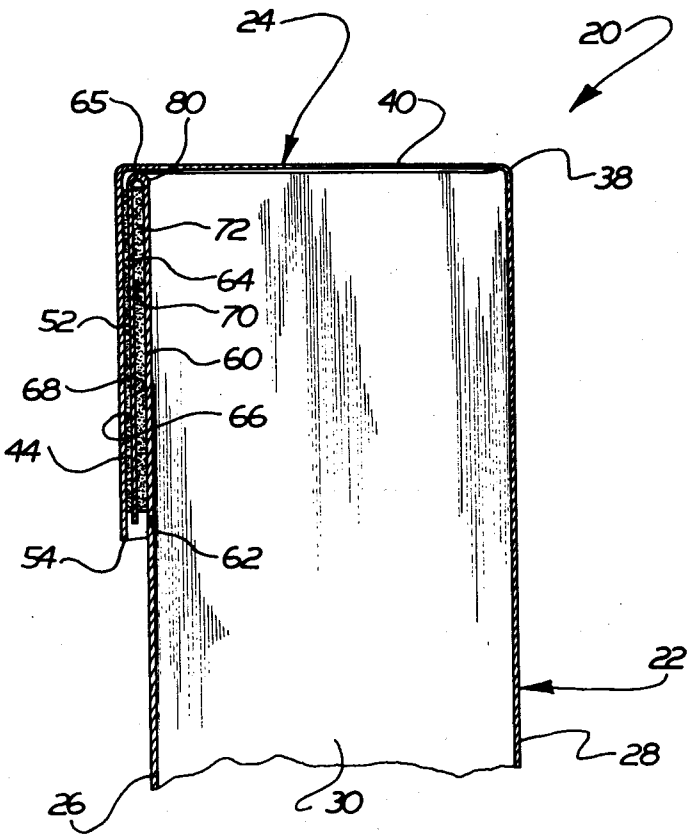
FIG. 2 is an enlarged fragmentary sectional view, taken generally along the line 2—2 of FIG. 1, illustrating the manner in which a cover of the receptacle is firmly held in the closed position until the receptacle is initially opened.
Figure 3:
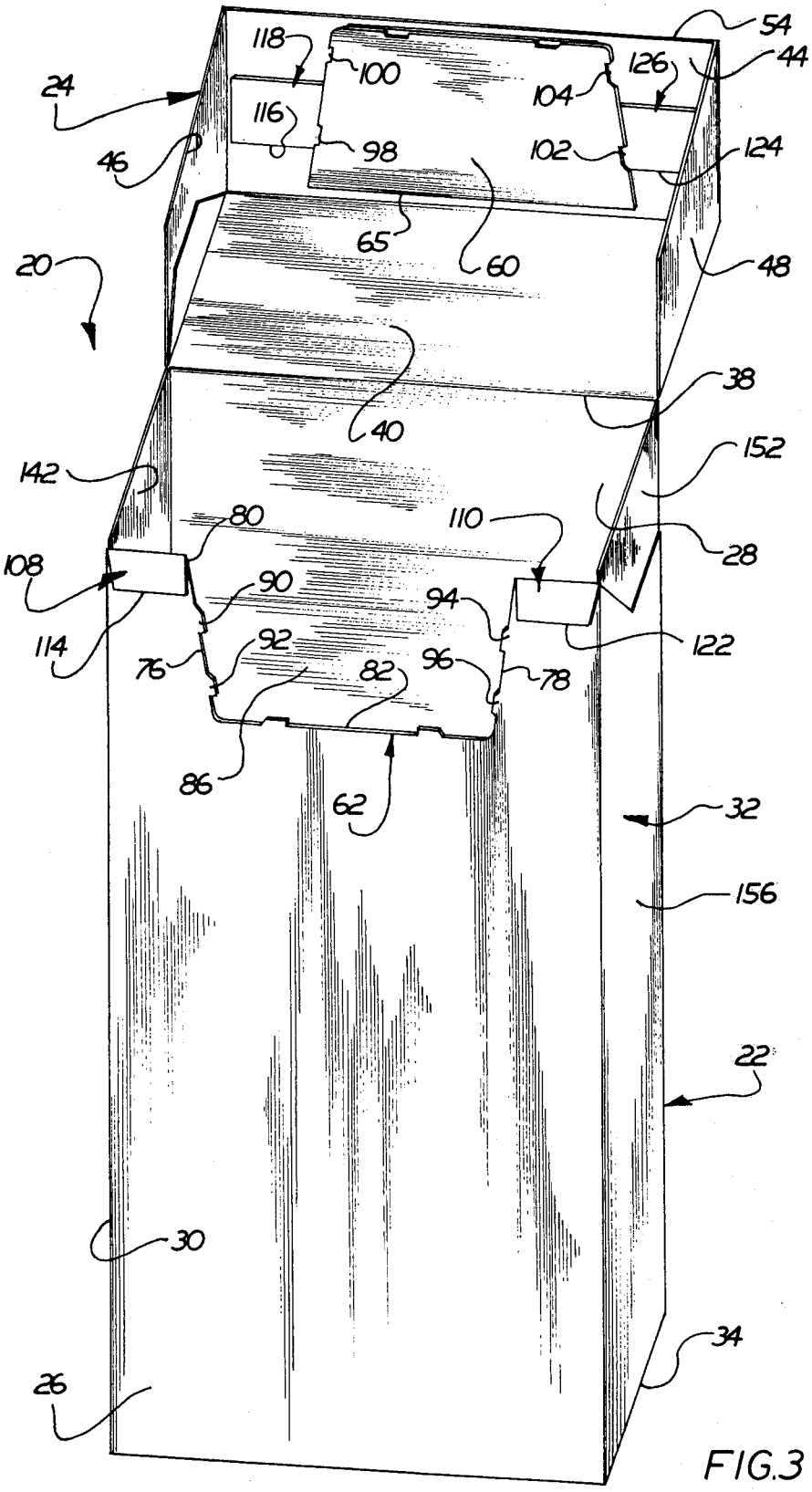
FIG. 3 is a perspective view of the receptacle of FIG. 1 with the cover in an open position.

The cover or flip top 24 is movable between a closed position (FIGS. 1 and 2) blocking access to the interior of the receptacle 20 and an open position (FIG. 3) in which articles within the receptacle are accessible. To enable the cover 24 to be repeatedly moved between the open and closed positions, the cover is pivotally or hingedly connected with an upper edge of the rear panel 28 along a fold or hinge line 38 (FIGS. 2 and 3). The fold line 38 extends parallel to the bottom panel 34 and interconnects the back panel 28 and flat upper or top section 40 of the cover. The top section 40 of the cover 24 extends parallel to the bottom panel 34 when the cover is in the closed position of FIGS. 1 and 2.

In addition to the top section 40, the cover 24 has a flat front section 44 which extends perpendicular to the top section 40. When the cover 24 is in the closed position of FIGS. 1 and 2, the front section 44 is disposed in juxtaposition with the front panel 26. The cover 44 also has a pair of side sections 46 and 48 (see FIG. 3) which extend perpendicular to the front section 44. The side sections 46 and 48 are disposed in juxtaposition with the side panels 30 and 32 when the cover 24 is in the closed position of FIG. 1.

In accordance with a feature of the present invention, the cover 24 is firmly held in the closed position until the receptacle 20 is intentionally opened. This prevents the cover 24 from being inadvertently dislodged to a partially raised position under the influence of forces commonly encountered during normal handling of the receptacle 20. Thus, when the cover 24 is in the closed position of FIGS. 1 and 2, the entire front section 44 of the cover is firmly anchored in a parallel relationship with the front panel 26 by a layer 52 (FIG. 2) of adhesive. The layer 52 of adhesive extends downwardly to a location immediately adjacent to a lower edge or lip 54 of the front portion 44 of the cover 24.

The application to the receptacle of the forces encountered in normal handling of a package urge the lip 54 of the cover in a direction tending to move the front section 44 of the cover upwardly and/or outwardly away front the front panel 26. However, the layer 52 of adhesive firmly holds the cover in place. This prevents the cover 24 from being dislodged to a cocked or slightly open position until the somewhat larger force required to initially move the cover 24 from the closed position to the open position is applied to the cover.

In order to provide for opening of the receptacle 20, a force of a predetermined magnitude must applied to the cover 24. This results in an opening of the receptacle 20 with a controlled tearing away of a predetermined portion of the front panel 26. To this end, front panel 26 is provided with a rip or pull out section 60 (see FIGS. 2 and 3) which is defined by a line of weakness or score line 62 (FIG. 2) in the front panel 26.

The rip out section 60 is integrally formed with a similarly shaped base section 64 (FIG. 2). The rip out section 60 is connected with the base section 64 along a fold line 65. An outer major side surface 66 of the base section 64 is connected with an inner major side surface of the front section 44 by the layer 52 of adhesive. Similarly, an inner major side surface 68 (FIG. 2) of the base section 64 is connected with an outer major side surface 70 of the rip out section 60 by a layer 72 of adhesive.

The adhesive layers 52 and 72 secure the rip out section 60 to the cover 24 so that upon pulling outwardly of the cover 24 from the closed position shown in FIG. 2 to the open position shown in FIG. 3, the front panel 26 tears along the score line 62. The score line 62 has a generally U-shaped configuration with a pair of side sections 76 and 78 (see FIG. 3) which extend downwardly from an upper edge 80 of the front panel 26 to a bight or cross section 82 which extends parallel to the bottom panel 34.

To provide a line of weakness in the front panel 26, the score line 62 is formed by short cuts which extend through the cardboard panel 26. These short cuts are interspersed with uncut sections of the front panel 26. This enables the rip out section 60 to be torn from the front panel 26 in a controlled manner so that the section will have the configuration shown in FIG. 3.

In accordance with another feature of the present invention, upon movement of the cover from the closed position of FIG. 2 to the open position of FIG. 3, an opening 86 is formed in the front panel 26 to at least partially expose the contents of the receptacle 20. Thus, the opening 86 extends downwardly from the upper edge 80 of the front panel 26 toward the bottom panel 34 and exposes a portion of the contents of the package which was previously behind the front section 44 of the cover 24. Of course, the opening 86 is formed when the rip out section 60 is torn from the front panel 26 during opening of the cover 24.

After the receptacle 20 has been opened, it is contemplated that only a portion of the contents of the receptacle may be removed and the cover returned to the closed position of FIG. 2 in order to protect the remaining contents of the receptacle. In accordance with still another feature of the present invention, the cover 24 is firmly held closed after the receptacle 20 has been initially opened. This results in the cover being held in place to protect the remaining contents of the receptacle.

When the cover 24 is moved from the open position of FIG. 3 back to the closed position of FIG. 2, projections and/or indentations formed along the score line 62 on the front panel 26 and rip out section 60 intermesh to hold the cover in the closed position. Thus, projections 90 and 92 (FIG. 3) along the side 76 of the opening 86 and projections 94 and 96 along the side 78 of the opening engage recesses 98 and 100 along one side of the rip out section 60 and recesses 102 and 104 along the opposite side of the rip out section. The engagement of the projections 90–96 with the recesses 98–104 releasably holds the cover 24 in the closed position shown in FIG. 2 when the receptacle 20 is closed after it has been initially opened.

A pair of locking or retaining tabs 108 and 110 along opposite sides of the opening 86 cooperate with the cover 24 to further hold the cover in the closed position. Thus, the retaining tab 108 has a lower edge or minor side surface 114 which engages a stop edge or minor side surface 116 on a locking flange 118 (FIG. 3) when the cover 24 is closed. The locking flange 118 is fixedly mounted on the inner side surface of the front section 44 of the cover by the adhesive layer 52.

Similarly, the retaining tab 110 has a lower edge or minor side surface 122 which engages a stop edge or minor side surface 124 on a locking flange 126 (FIG. 3) when the cover 24 is closed. The locking flange 126 is fixedly mounted on the inner side surface of the front section 44 of the cover by the adhesive layer 52.

The two locking flanges 118 and 126 are integrally formed with the base 64 and project outwardly from opposite sides of the base 64. The stop surfaces 116 and 124 on the flanges 118 and 126 extend parallel to the edge 54 of the cover 24. Similarly, the stop surfaces 114 and 122 on the tabs 108 and 110 extend parallel to the upper edge 80 of the front panel 26. Of course, the stop surfaces 116, 124, 114 and 122 could be skewed relative to the upper edge 80 of the front panel 26 and/or the lower edge 54 of the cover 24 if desired.

When the cover 24 is pivoted about the fold line 38 from the open position of FIG. 3 to the closed position of FIG. 2, the locking tabs 108 and 110 are pivoted inwardly about fold lines which connect them with the upper edge 80 of the front panel 26. As the cover 24 moves to the fully closed position shown in FIG. 2, the natural resilience of the locking tabs causes them to pivot outwardly about the fold lines at the upper edge of the front panel 26. This results in the top surfaces 114 and 122 (FIG. 3) moving into alignment with the surfaces 116 and 124 on the flanges 118 and 126. Abutting engagement between the stop surfaces 114 and 122 on the tabs and the stop surfaces 116 and 124 on the flanges holds the cover in the closed position shown in FIG. 2. However, when a firm force is applied to the cover urging it toward the open position of FIG. 3, the locking flanges 118 and 126 tend to move outwardly away from the front panel 26 and the tabs 108 and 110 become disengaged from the locking flanges to release the cover for movement to the open position of FIG. 3.

When the cover 24 is initially opended, the front panel 26 is ripped along the score line 62 to separate the rip out section 60 from the front panel. When the cover 24 is return to the closed position of FIG. 2, it is held in place by two separate locking or retaining devices. Thus, the cover is held closed by engagement of the projections 90, 92, 94 and 96 with the recesses 98, 100, 102 and 104. The cover is also held closed by engagement of the locking tabs 108 and 110 with the flanges 118 and 126 on the inside of the cover.

Figure 4:
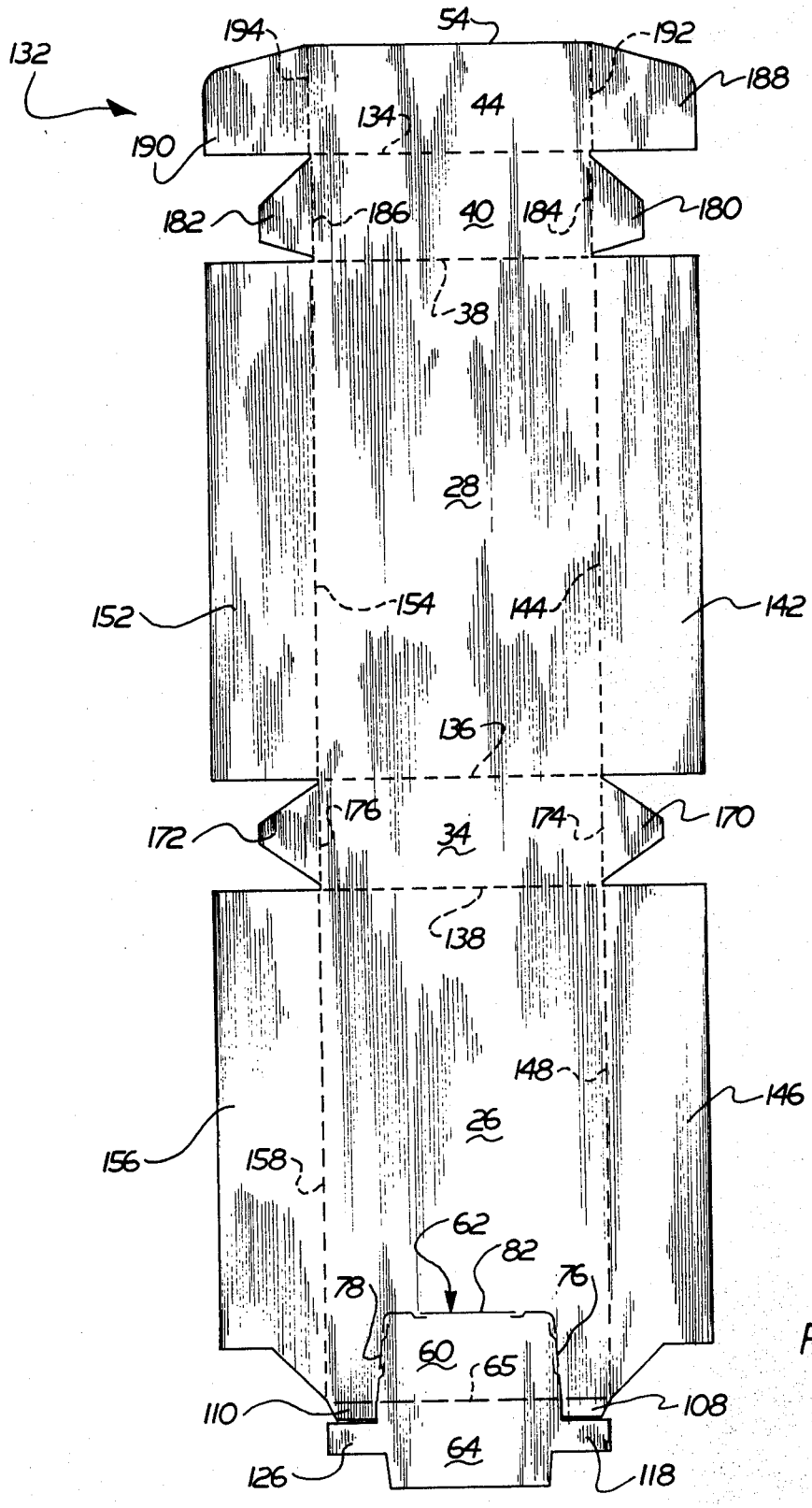
FIG. 4 is an plan view of a blank from which the receptacle of FIGS. 1–3 is formed.

The receptacle 20 is formed from a flat paperboard or cardboard blank 132 (see FIG. 4) having crease or fold lines separating the various panels. Thus, the blank 132 has a crease or fold line 134 which extends parallel to the edge 54 of the cover section 44 to separate the cover section from the top section 40 of the cover. Similarly, the fold line 38 extends parallel to the edge 54 and separates the top section 40 of the cover from the back panel 28. A pair of fold lines 136 and 138 (FIG. 4) extend parallel to the fold line 38 and separate the bottom panel 34 from the back panel 28 and front panel 26.

The side panels 30 and 32 of the receptacle 20 are formed by overlapping flaps. Thus, the side panel 30 includes an inner flap 142 (FIG. 4) which is separated from the rear panel 28 by fold line 144 and a flap 146 which is separated from the front panel 26 by a fold line 148 which is a continuation of the fold line 144. The fold lines 144 and 148 extend perpendicular to the fold line 38. The opposite side panel 32 (see FIG. 3) is formed by a flap 152 (FIG. 4) which is separated from the rear panel 28 by a fold line 154 and a flap 156 which is separated from the front panel 26 by a fold line 158. The fold line 158 is a continuation of the fold line 154 and extends parallel to the fold lines 144 and 148.

Figure 6:
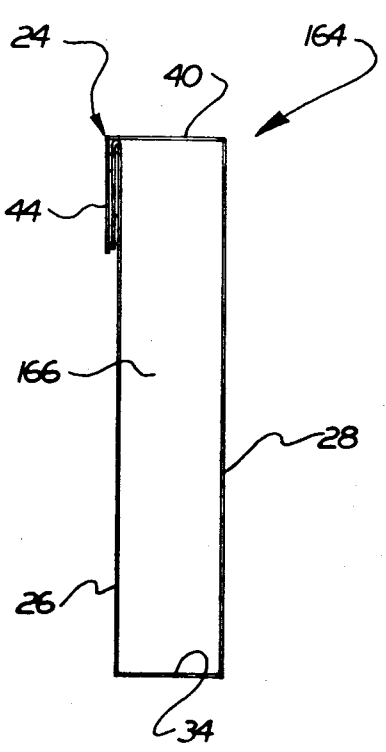
FIG. 6 is an elevational view, taken generally along the line 6—6 of FIG. 5 and illustrating the tubular configuration of the receptacle prior to filling.
Figure 5:
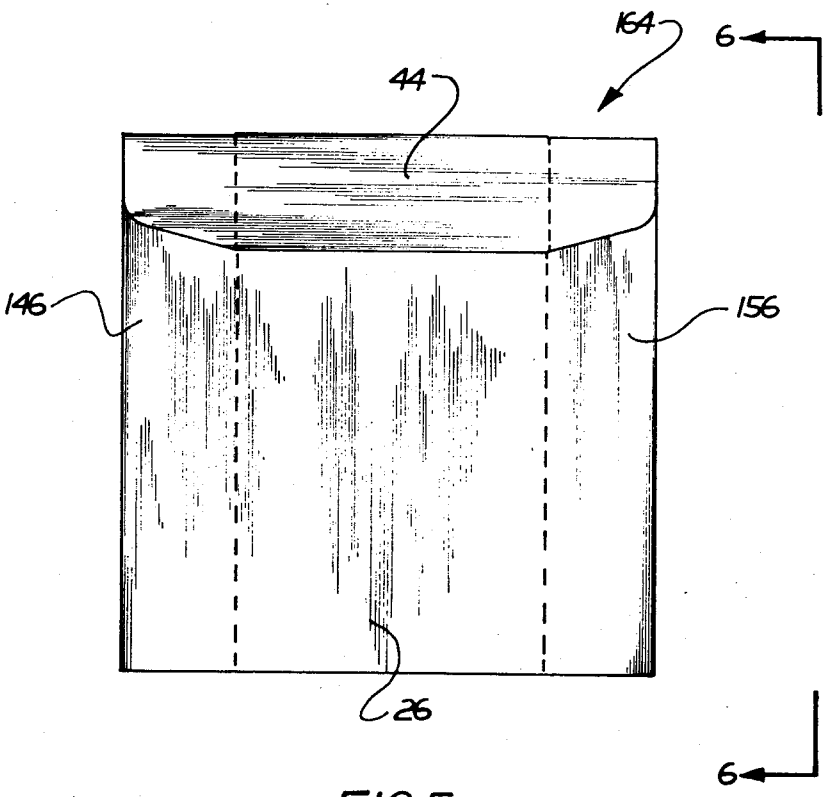
FIG. 5 is an elevational view of the blank of FIG. 4 after the cover has been secured to the front panel and prior to filling and closing of side panels of the receptacle.

To allow the receptacle 20 to be filled from either side rather than the top, the adhesive layers 72 and 52 are connected between the base 64 and the front panel 26 and front section 44 of the cover in the manner shown in FIG. 2. This results in the formation of a tubular structure 164 (see FIGS. 5 and 6) which corresponds to the receptacle 22 with the two side panels 30 and 32 open. The resulting tubular structure (see FIG. 6) has a rectangular opening 166 which extends completely through the structure. It should be noted that the cover 24 is, with the exception of the opposite sides, almost fully formed at this time. However, the tubular structure is open on opposite sides so that articles can be inserted into the tubular structure 164 from either side.

Once the tubular structure 164 has been filled, the inner flaps 142 and 152 (see FIG. 4) are folded in to block the openings on opposite sides of the tubular structure 164. A pair of bottom flaps 170 and 172 are then folded in along fold lines 174 and 176. The outer side flaps 146 and 156 are then folded inwardly into abutting engagement with the inner side flaps 142 and 152 and with the bottom flaps 170 and 172. This results in the bottom flaps being sandwiched between inner side flaps 142 and 152 and the outer side flaps 146 and 156. Suitable adhesive is provided between the side flaps 142 and 146 and 152 and 156 to hold the side flaps in juxtaposition with each other. If desired, one pair of side flaps 142, 146 or 152, 156 could be closed before filling of the tubular structure 164.

Once the side panels 30 and 32 have been formed, the construction of the cover 24 is completed. This is done by folding the top flaps 180 and 182 (FIG. 4) inwardly along fold lines 184 and 186 and folding front flaps 188 and 190 inwardly about fold lines 192 and 194. The top flaps 180 and 182 and front flaps 188 and 190 are held in juxtaposition with each other by suitable adhesive between the flaps to complete the construction of the receptacle 20.

In the embodiment of the invention illustrated in FIGS. 1–6, the rip out section 60 is connected with the front section 44 of the cover by a base 64. The base 64 has outwardly extending locking flanges 118 and 126 which are engaged by the tabs 108 and 110 to hold the cover 24 in the closed position after initial opening of the receptacle 20. In the embodiment of the invention shown in FIGS. 7 and 8, the rip out section is mounted directly on the inner side surface of the front section of the cover and locking tabs engage retaining sections which are formed separately from the rip out section. Since the embodiment of the invention shown in FIGS. 7 and 8 is generally similar to the embodiment of the invention shown in FIGS. 1–6, similar numerals will be utilized to designate similar components, the suffix letter "a" being associated with the embodiment of the invention shown in FIGS. 7 and 8 to avoid confusion.

A receptacle **20*a* (FIG. 7) has rectangular main section 22*a* and a cover or flip top 24*a*. A front panel 26*a* extends parallel to a back panel 28*a*. A bottom panel (not shown) extends between the front and back panels 26*a* and 28*a* and a pair of side panels 30*a* and 32*a*. The cover 24*a* is pivotally connected with the back panel 28*a* along a fold line 38*a***.

Figure 7:
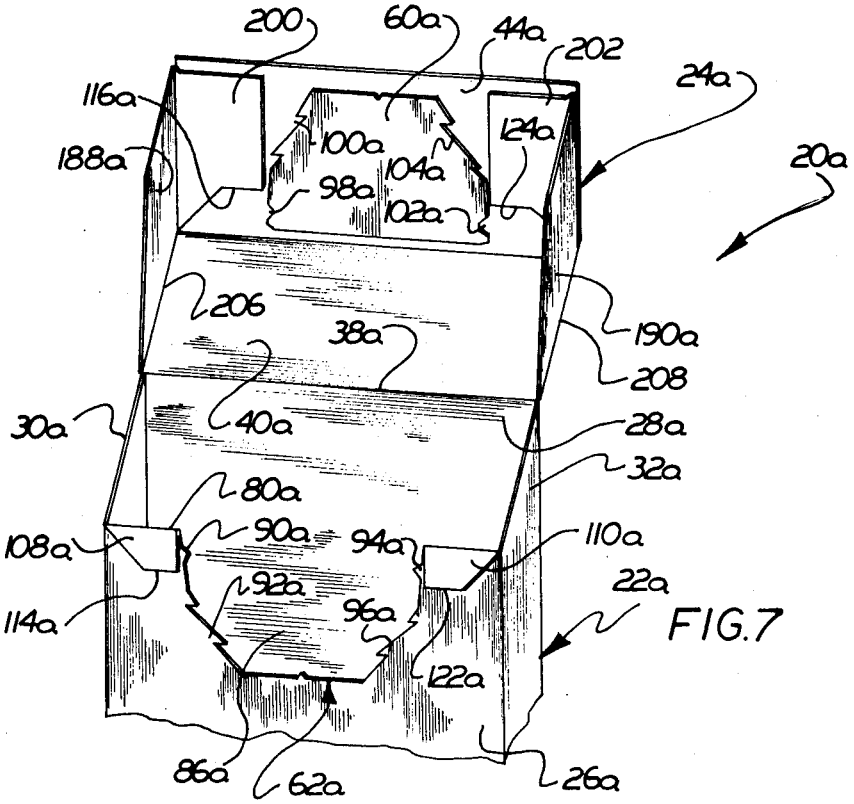
FIG. 7 is a fragmentary perspective view of a receptacle forming a second embodiment of the invention, the receptacle being shown in the open condition.
Figure 8:
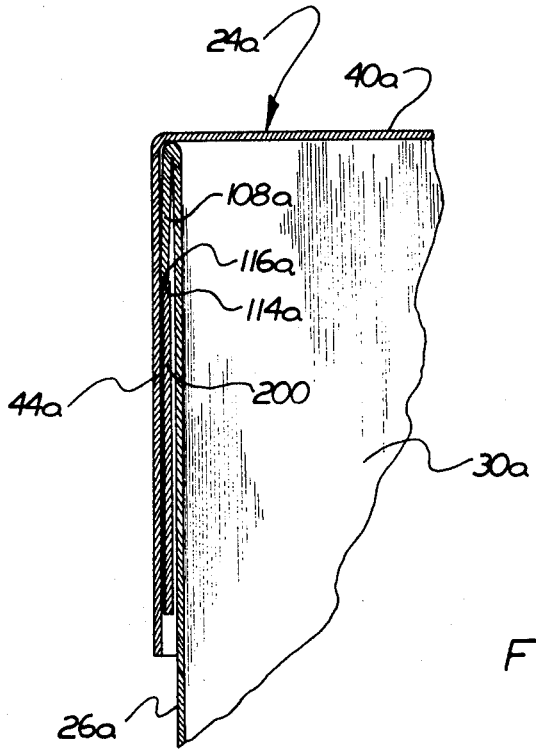
FIG. 8 is an enlarged fragmentary sectional view of the embodiment of the invention illustrated in FIG. 7 and depicting the relationship between a closed cover and a front panel of the receptacle prior to initial opening of the receptacle.

When the cover **24*a* is initially moved from a closed or sealed position to the open position of FIG. 7, a rip out section 60*a* is removed from the front panel 26*a*. This is accomplished by tearing the front panel 26*a* along a line of weakness or score line 62*a* to form an opening 86*a* which extends downwardly from an upper edge 80*a* of the front panel 26*a*. The rip out section 60*a* is secured directly to a front section 44*a* of the cover 24*a*** by a suitable adhesive.

When the cover **24*a* is moved back to the closed position, projections 90*a*, 92*a*, 94*a*, and 96*a* formed in the front panel 26*a* along the score line 62*a* engage recesses 98*a*, 100*a*, 102*a* and 104*a* formed in the rip out section 60*a*. The meshing engagement between the projections 90*a*, 92*a*, 94*a* and 96*a* and the recesses 98*a*, 100*a*, 102*a* and 104*a*** hold the cover in the closed position.

Locking or retaining tabs **108*a* and 110*a* are formed along the upper edge 80*a* of the front panel 26*a* to further hold the cover 24*a* closed. The retaining tabs 108*a* and 110*a* have minor side or stop surfaces 114*a* and 122*a* which cooperate with minor side or stop surfaces 116*a* and 124*a* disposed on the inner side of the front section 44*a* of the cover 24*a*. In accordance with a feature of this embodiment of the invention, the stop or retaining surfaces 116*a* and 124*a* are disposed on flaps 200 and 202 which are integrally formed with the side flaps 188*a* and 190*a* which are connected with the top section 40*a* along fold lines 206 and 208**.

When the cover **24*a* is in the closed position shown in FIG. 8, the surface 114*a* on the locking tab 108*a* engages the surface 116*a* on the flap 200. Similarly, the surface 122*a* on the locking tab 110*a*** engages the surface 124*a* on the flap 202 when the cover 24*a* is closed. Abutting engagement of the retaining tabs 108*a* and 110*a* with the flaps 200 and 202 holds the cover 24*a* in the closed position. When a force is applied to the cover 24*a* lifting the front section 44*a* upwardly and outwardly to pivot the cover about the fold line 38*a*, the locking tabs 108*a* and 110*a* are disengage from the flaps 200 and 202 and the cover moves to the open position shown in FIG. 7.

Figure 9:
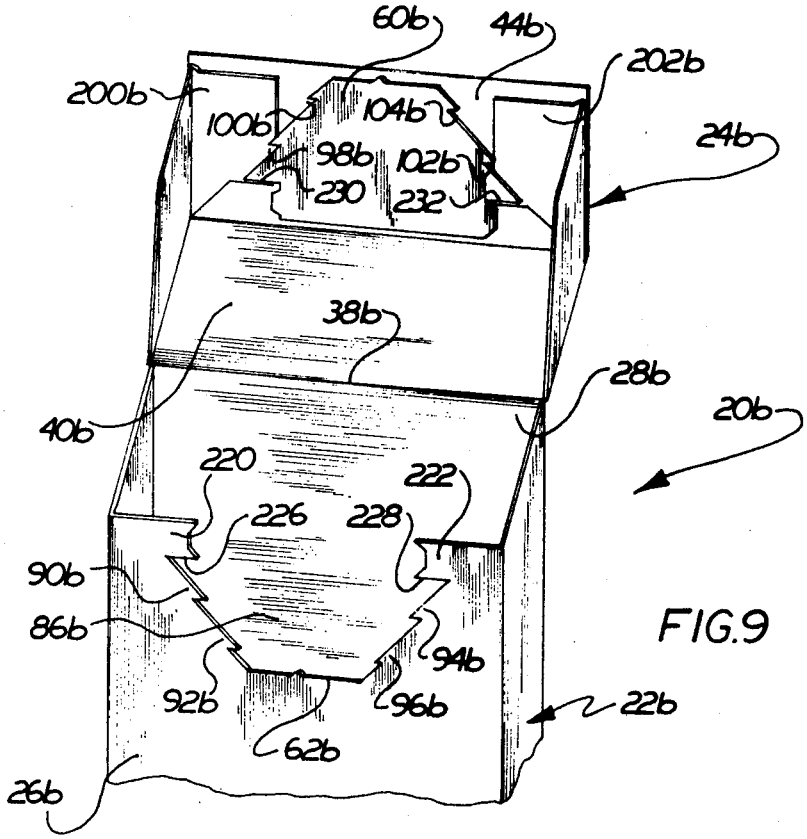
FIG. 9 is a fragmentary perspective view illustrating another embodiment of the invention, the receptacle being shown in the open condition.
Figure 10:
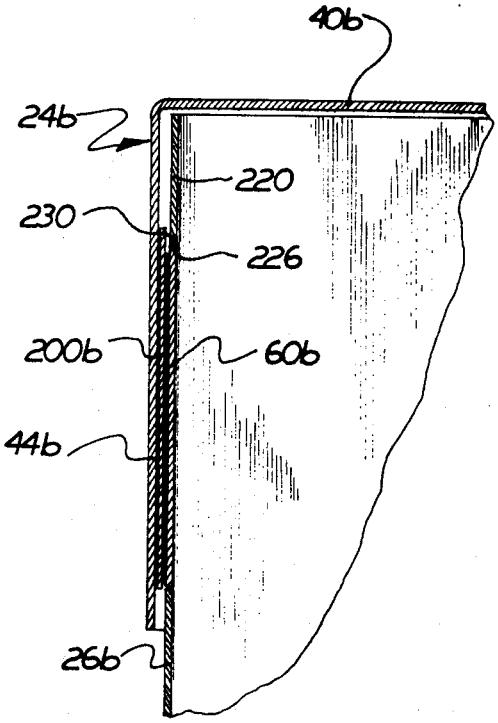
FIG. 10 is an enlarged fragmentary sectional view of the embodiment of the invention illustrated in FIG. 9 and depicting the relationship between a closed cover and a front panel of the receptacle when the cover has been closed after having initially been opened.

In the embodiment of the invention shown in FIG. 9, the function of the locking tabs 108, 108*a* and 110, 110*a* of the embodiments shown in FIGS. 1–8 is performed by a portion of the front panel. Since the embodiment of the invention shown in FIGS. 9 and 10 is generally similar to the embodiments of the invention shown in FIGS. 1–8, similar numerals will be utilized to designate similar components, the suffix letter "b" be associated with the embodiment of FIGS. 9 and 10 in order to avoid confusion.

A receptacle 20*b* (FIG. 9) has a rectangular main body section 22*b* to which a cover 24*b* is pivotally connected to a rear panel 28*b* along a fold line 38*b*. Upon initial opening of the receptacle 20*b*, a rip out section 60*b* is removed from a front panel 26*b* along a score line 62*b*. The rip out section 60*b* is fixedly connected with an inner side surface of a front section 44*b* of the cover 24*b* by a suitable adhesive. However, it should be noted that flaps 200*b* and 202*b* underlie a portion of the rip out section 60*b*.

In accordance with a feature of this embodiment of the invention, the opening 86*b* formed by removing the rip out section 60*b* is provided with a pair of inwardly projecting tabs or flanges 220 and 222 which cooperate with the rip out section 60*b* to hold the cover 24*b* closed. Thus, after the cover 24*b* has been moved from the open position of FIG. 9 to the closed position of FIG. 10 the flanges 220 and 222 abut the rip out section 60*b*. The tabs 220 and 222 (FIG. 9) have downwardly facing minor side or retaining surfaces 226 and 228 which engage minor side or retaining surfaces 230 and 232 formed on the rip out section 60*b* to hold the cover in the closed position (see FIG. 10). Thus, the function of the locking tabs 108 and 110 of the embodiment of invention shown in FIG. 3 is performed by the tabs or flanges 220 and 222 which are defined by the score line 62*b* and are formed when the rip out section 60*b* is removed from the front panel 26*b*.

When the cover 24*b* is returned to the closed position, it is held closed under the combined influence of the locking tabs 220 and 222 and of meshing engagement between projections formed in the front panel 26*b* at the opening 86*b* and recesses in the rip out section 60*b*. Thus, the front panel 26*b*, has projections 90*b*, 92*b*, 94*b* and 96*b* which cooperate with recesses 98*b*, 100*b*, 102*b* and 104*b* to retain the cover 24*b* in the closed position.

Although specific preferred embodiments of the invention have been illustrated in FIGS. 1–10, it should be understood that a receptacle constructed in accordance with the present invention could have a somewhat different constructuion if desired. For example, the locking tabs 220 and 222 of the embodiment of the invention shown in FIG. 9 could extend completely across the upper portion of the openings 86*b*. In addition, if desired, the rip out sections 60*a* and 60*b* (FIGS. 7 and 9) could be mounted on the front section 44*a* or 44*b* of a cover with a base similar to the base 64 of FIG. 2. In addition, the overall configuration of the receptacle could be changed from the elongaged rectangular configuration illustrated herein.

In view of the foregoing description, it is apparent that a receptacle 20 constructed in accordance with the present invention includes a cover 24 which is pivotally connected with a back panel 28 for movement between open and closed positions. The front panel 26 has a rip or pull out section 60 which is defined by a score line 62. Adhesive 52 connects the rip or pull out section 60 in flat juxtaposition with an inner side of the front section 44 of the cover 24 to hold the front section of the cover in flat abutting engagement with the front panel 26 prior to opening of the receptacle. When the receptacle is initially opened, the adhesive causes the rip out section 60 to tear away from the front panel 26 of the receptacle to form an opening 86 in the front panel and expose the contents of the receptacle.

Once the receptacle has been opened and the cover 24 moved back to the closed position, a pair of locking or retaining tabs 108 and 110 on the upper edge portion 80 of the front panel 26 engage surfaces 116 and 124 on the inside of the front section 44 of the cover 24 to hold the cover in the closed position. In addition, the cover is held in the closed position by meshing engagement between indentations 98, 100, 102 and 104 and projections 90, 92, 94 and 96 formed by removing the rip out section 60 from the front panel 26 of the receptacle.

Having described specific preferred embodiments of the invention, the following is claimed:

1. A receptacle comprising spaced apart front and back panels, a pair of side panels extending between said front and back panels, a bottom panel connected with lower edges of said front, back and side panels, a cover pivotally connected with said back panel for movement between a closed position blocking access to the interior of said receptacle and an open position in which said cover is ineffective to block access to the interior of said receptacle, said cover including an upper section which extends between said front and rear panels when said cover is in the closed position and a front section which is disposed in flat juxtaposition with said front panel when said cover is in the closed position, said front panel including a rip out section defined by a score line, said score line having first and second spaced apart sections extending downwardly from an upper edge toward a lower edge of said front panel at locations spaced inwardly from said side panels and a third section extending between said first and second sections of said score line at a location between the upper and lower edges of said front panel, and adhesive means for connecting said rip out section in flat juxtaposition with an inner side of said front section of said cover to hold said front section of said cover in flat abutting engagement with said front panel upon application to a lower edge portion of said front section of said cover of a force insufficient to tear said front panel along said score line and prior to opening of said receptacle, said adhesive means being effective to cause tearing of said front panel along said score line upon initial movement of said cover to the open position to form an opening which extends downwardly from the upper edge of the front panel toward the lower edge of the front panel to at least partially expose the contents of the receptacle, said front section of said cover having a lower edge which is disposed between a lower edge of the opening in the front panel and the lower edge of the front panel when said cover is in the closed position to enable said front section of said cover to block the opening in the front panel.

2. A receptacle as set forth in claim 1 further including retaining means for retaining said cover in the closed position when said cover is moved back to the closed position after opening of the receptacle, said retaining means including a pair of surfaces projecting from the inner side of the front section of said cover and first and second retaining tabs pivotally connected with the upper edge portion of said front panel at locations between said side panels and the intersections of said first and second sections of said score line with the upper edge of said front panel, said retaining tabs having free end portions which abut said surfaces which project from the inner side of the front section of said cover when said cover is in the closed position.

3. A receptacle as set forth in claim 2 further including a base section connected with said rip out section along a fold line, said adhesive means including means for securing a first side of said base section in flat abutting engagement with the inner side of said front section of said cover and means for securing a second side of said base section in flat abutting engagement with a side of said rip out section, said base section having a pair of projecting sections upon which said pair of surfaces are disposed.

4. A receptacle as set forth in claim 1 wherein said first and second sections of said score line include straight sections and sections which project from said straight sections, said sections of said score line which project from said straight sections forming indentations and projections at said rip out section and opening in said front panel upon initial movement of said cover from the closed position to the open position, said indentations and projections at said rip out section and opening in said front panel meshing upon movement of said cover from the open position to the closed position to hold said cover in the closed position.

5. A flip top box formed of a suitably cut and scored blank having a receptacle portion and a cover portion telescoping over the upper edges of said receptacle portion, said receptacle portion comprising hingedly connected front, rear, side and bottom panels, said front panel including a pull-out portion at the upper edge thereof attached to said front panel along a detachable line of weakness, said cover portion comprising a top cover panel hingedly connected to the upper edge of said rear panel, a front cover panel hingedly connected to said top cover panel and end cover flaps hingedly connected to said top and front cover panels, a pair of locking flaps hingedly connected to the upper edge of said front panel and being folded outwardly about their hinge lines to lie between said front cover panel and said front receptacle panel, a sealing tab hingedly connected to the upper edge of said front panel and folded outwardly about its hinge line to lie between said front panel and said front cover panel, said sealing tab being adhesively secured to the outer surface of said pull-out portion and to the inner surface of said front cover panel and having a pair of side flaps cooperating with said locking flaps.

6. A flip top box as set forth in claim 5 wherein each of said locking flaps comprises a side edge cooperating with the lower side portion of said sealing tab and an upper edge cooperating with the lower edge of said side flap.

7. A flip top box as set forth in claim 5 wherein said sealing tab has a shape corresponding to the shape of said pull-out portion.

8. A receptacle comprising spaced apart front and back panels, a pair of side panels extending between said front and back panels, a bottom panel connected with lower edges of said front, back and side panels, a cover pivotally connected with said back panel for movement between a closed position blocking access to the interior of said receptacle and an open position in which said cover is ineffective to block access to the interior of said receptacle, said cover including an upper section which extends between said front and rear panels when said cover is in the closed position and a front section which is disposed in flat juxtaposition with said front panel when said cover is in the closed position, said front panel including a rip out section defined by a score line, said score line including a plurality of generally straight sections and sections which project outwardly from said straight sections, and adhesive means for connecting said rip out section with said cover, said adhesive means being effective to cause tearing of said front panel along said score line upon initial movement of said cover to the open position to form an opening in said front panel, said sections of said score line which project outwardly forming indentations and projections at said rip out section and the opening in said front panel upon initial movement of said cover from the closed position to the open position, said indentations and projections at said rip out section and the opening in said front panel meshing upon movement of said cover from the open position to the closed position to hold said cover in the closed position.

9. A receptacle as set forth in claim 8 further including a pair of retaining sections extending outwardly from opposite sides of said rip out section and connected with said cover by said adhesive means, and a pair of retaining tabs pivotally connected with said front panel on opposite sides of the opening in said front panel, said retaining tabs engaging said retaining sections to further hold said cover in the closed position.

* * * * *